US006131484A

United States Patent [19]

Wang

[11] Patent Number: 6,131,484

[45] Date of Patent: Oct. 17, 2000

[54] GRIP OF GARDENING TOOL

[76] Inventor: Kuang-Pin Wang, No. 425, Ta-Tun 4th Street, Taichung, Taiwan

[21] Appl. No.: 09/294,371

[22] Filed: Apr. 20, 1999

[51] Int. Cl.[7] ..... G05G 1/10; B25B 23/00

[52] U.S. Cl. ..... 74/543; 74/551.9; 81/450; 81/490; 81/177.4

[58] Field of Search ..... 74/553, 543, 538, 74/523, 551.9, 558; 81/490, 450, 177.4; D8/303; 403/374; 29/80

[56] References Cited

U.S. PATENT DOCUMENTS

| | | | |
|---|---|---|---|
| D. 411,432 | 6/1999 | Stahel | D8/303 |
| 3,405,749 | 10/1968 | Butler | 74/551.9 X |
| 4,633,552 | 1/1987 | Eriksson | 29/80 |
| 4,991,461 | 2/1991 | Sennett et al. | 74/551.9 X |
| 5,263,275 | 11/1993 | Rumbaugh | 43/23 |
| 5,305,660 | 4/1994 | Hasegawa | 74/553 |
| 5,356,237 | 10/1994 | Sung | 403/374 |
| 5,918,513 | 7/1999 | Ho | 81/490 |
| 6,006,625 | 12/1999 | Nagashima | 74/501.6 |

FOREIGN PATENT DOCUMENTS

| | | | |
|---|---|---|---|
| 547888 | 6/1956 | Belgium | 74/551.9 |

*Primary Examiner*—Vinh T. Luong
*Attorney, Agent, or Firm*—Rosenberg, Klein & Lee

[57] ABSTRACT

A grip for a gardening tool is formed with a fitting hole adapted to prevent rotation of the tool. The inner wall of the fitting hole has multiple symmetrically arranged engaging faces which define a space for accommodating a flat, rectangular or hexagonal fitting section of different tools so as to avoid rotation of the tool's fitting section.

2 Claims, 6 Drawing Sheets

GRIP OF GARDENING TOOL

BACKGROUND OF THE INVENTION

The present invention relates to a grip of a gardening tool, which is formed with a fitting hole. The inner wall of the fitting hole is disposed with multiple symmetrically arranged engaging faces which define a specific space in which a flat, rectangular or hexagonal fitting section of different tools can be accommodated to firmly associate the grip with different tools.

There are various types of gardening tools which are used at different sites and for different purposes. These gardening tools can be used in association with a long stem.

Most of the existing gardening tools have flat, rectangular or hexagonal fitting sections. For example, FIGS. 9 and 10 respectively show a harrow 8 with a flat fitting section 81 and a hoe 9 with a hexagonal fitting section 91. The different fitting sections 81, 91 are used in accordance with different application forces and manner of working. The different fitting sections 81, 91 have different advantages. For example, the flat fitting section 81 is more easily manufactured, while the hexagonal fitting section 91 can be more firmly associated with the grip. However, different grips 83, 93 respectively formed with a flat fitting hole 82 and a hexagonal fitting hole 92 must be respectively co-used with the different fitting sections. Under such a circumstance, for use of a tool 9 with hexagonal fitting section 91, a grip 93 with the hexagonal fitting hole 92 must be prepared. When another tool formed with an otherwise shaped fitting section is used, a different grip must be further prepared. As a result, many different grips must be prepared for the tools with different fitting sections. This leads to a limitation on the use of the grip and increases costs.

SUMMARY OF THE INVENTION

In order to solve the above problems, it is a primary object of the present invention to provide a grip of a gardening tool, which is formed with a fitting hole. The inner wall of the fitting hole is disposed with multiple symmetrically arranged engaging faces which define a specific space for accommodating a flat, rectangular or hexagonal fitting section of different tools so as to avoid rotation of the fitting section. Therefore, the grip can be firmly associated with different tools to enlarge the useable range use for the grip. In addition, as different tools use the grip, costs are reduced.

The present invention can be best understood through the following description and accompanying drawings wherein:

DETAILED DESCRIPTION OF THE PREFERRED EMBODIMENT

Figure 1:
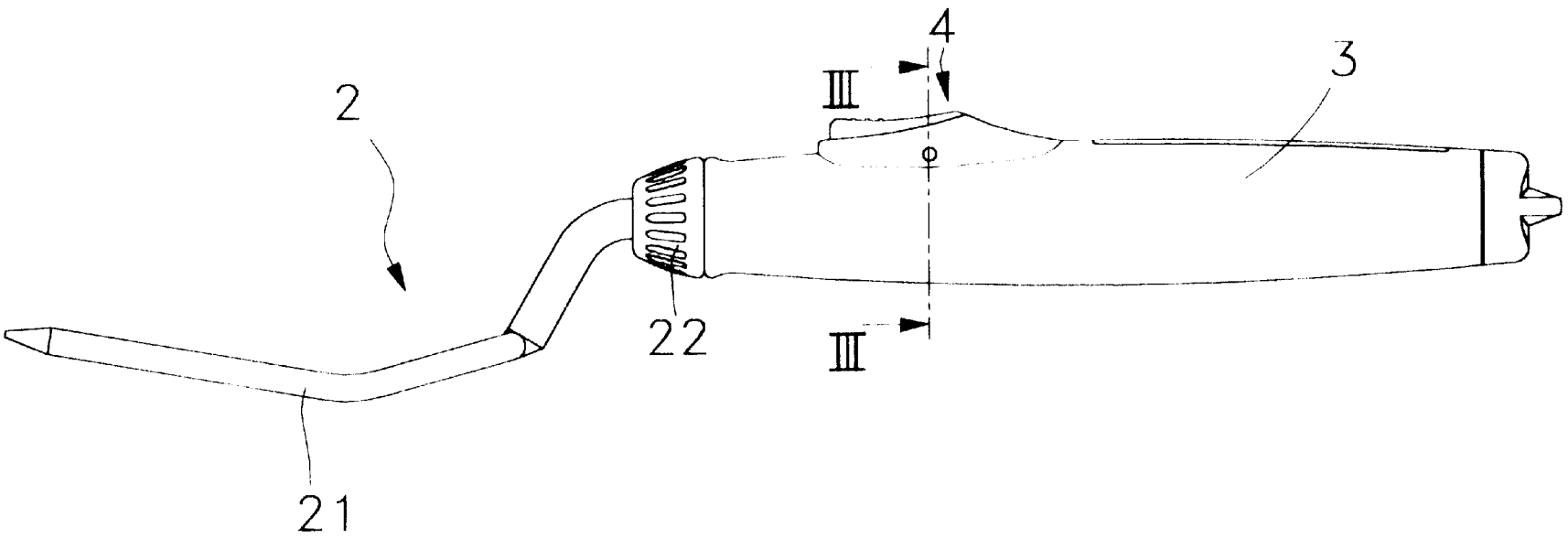
FIG. 1 is an assembled view of the present invention.
Figure 2:
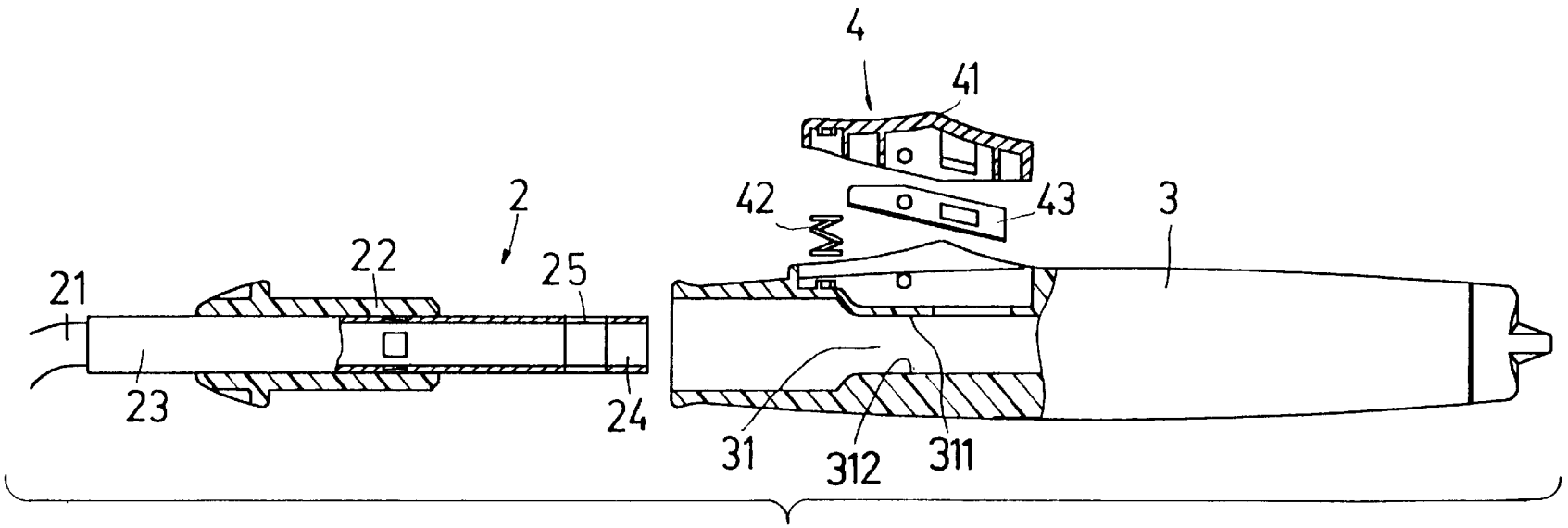
FIG. 2 is an exploded view, partially sectioned, of the present invention.
Figure 3:
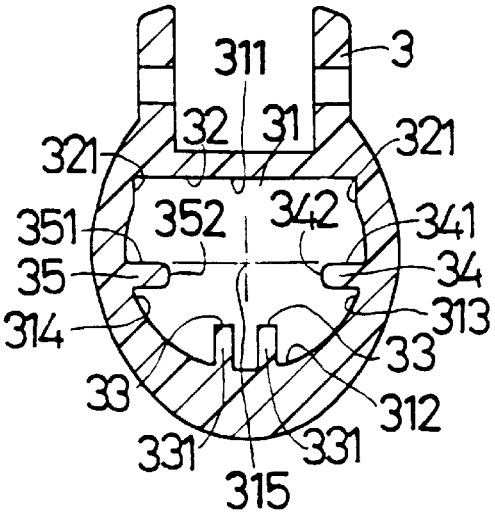
FIG. 3 is a sectional view taken along line III—III of FIG. 1, excluding the locating mechanism.

Please refer to FIGS. 1 to 3 and 7 and 8 which show a preferred embodiment of the present invention. The gardening tool includes a tool head 2 composed of a tool section 21 and a connector 22, a tool stem 23 fitted in the connector 22. One end of the tool stem 23 is fitted with the tool section 21, while the other end thereof has a fitting section 24 formed with a socket 25.

The gardening tool includes a grip 3 formed with a fitting hole 31 for insertion of the fitting section 24 of the tool head 2 therein, an inner top edge 311 and an inner bottom edge 312. The fitting hole 31 is respectively formed with a first and a second engaging face 32, 33. The second engaging face 33 is formed by engaging faces of two ribs 331 together. A left side 314 and a right side 313 of the fitting hole 31 are respectively disposed with first and second projections 34 and 35, which extend toward the axis 315. The opposite faces of the first and second projections 34, 35 are respectively formed with two third engaging faces 342, 352. The faces of the first and second projections 34, 35 opposite to the first engaging face 32 are two fourth engaging faces 341 and 351, which are parallel to the first engaging face 32 and positioned at the same height. The fitting hole 31 is further formed with two fifth engaging faces 321 on two sides of the first engaging face 32, the fifth engaging faces 321 being perpendicular to the first engaging face 32.

Figure 7:
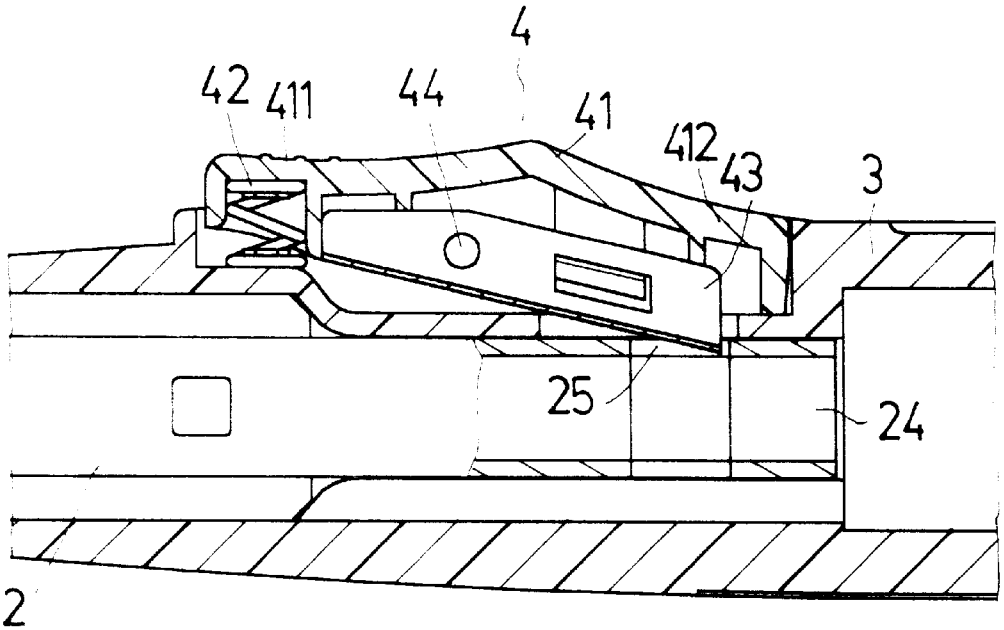
FIG. 7 is a sectional view of the locating mechanism of the present invention.
Figure 8:
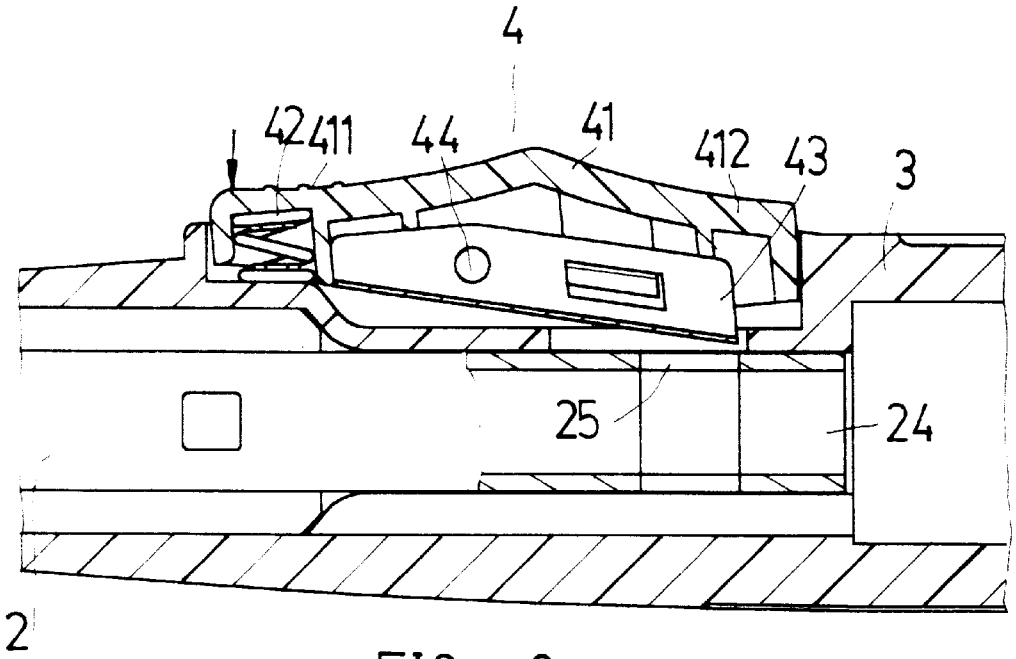
FIG. 8 shows the operation of the locating mechanism of the present invention.
Figure 9:
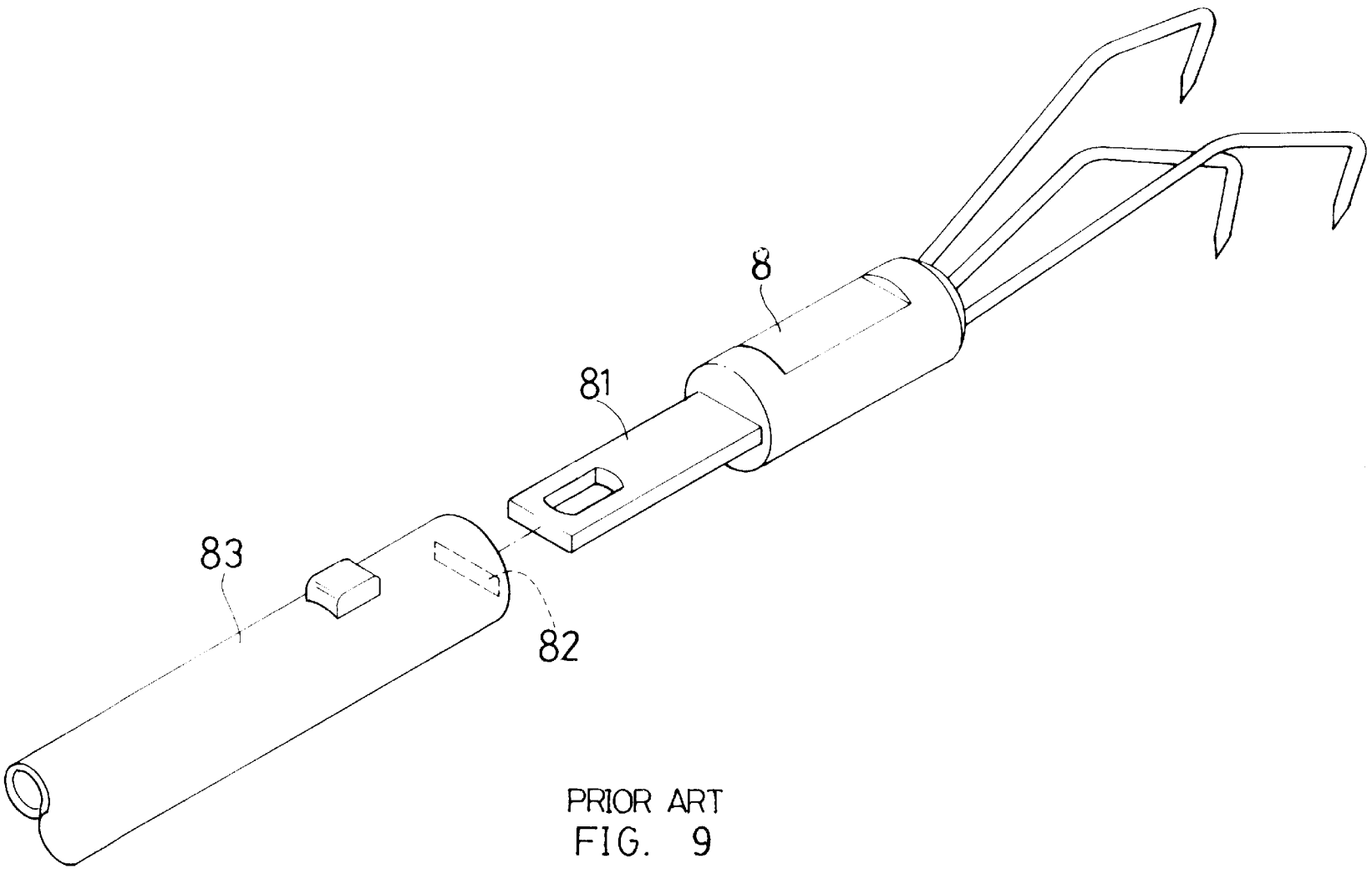
PRIOR ART FIG. 9
FIG. 9 is a perspective exploded view of a conventional grip and gardening tool head.
Figure 10:
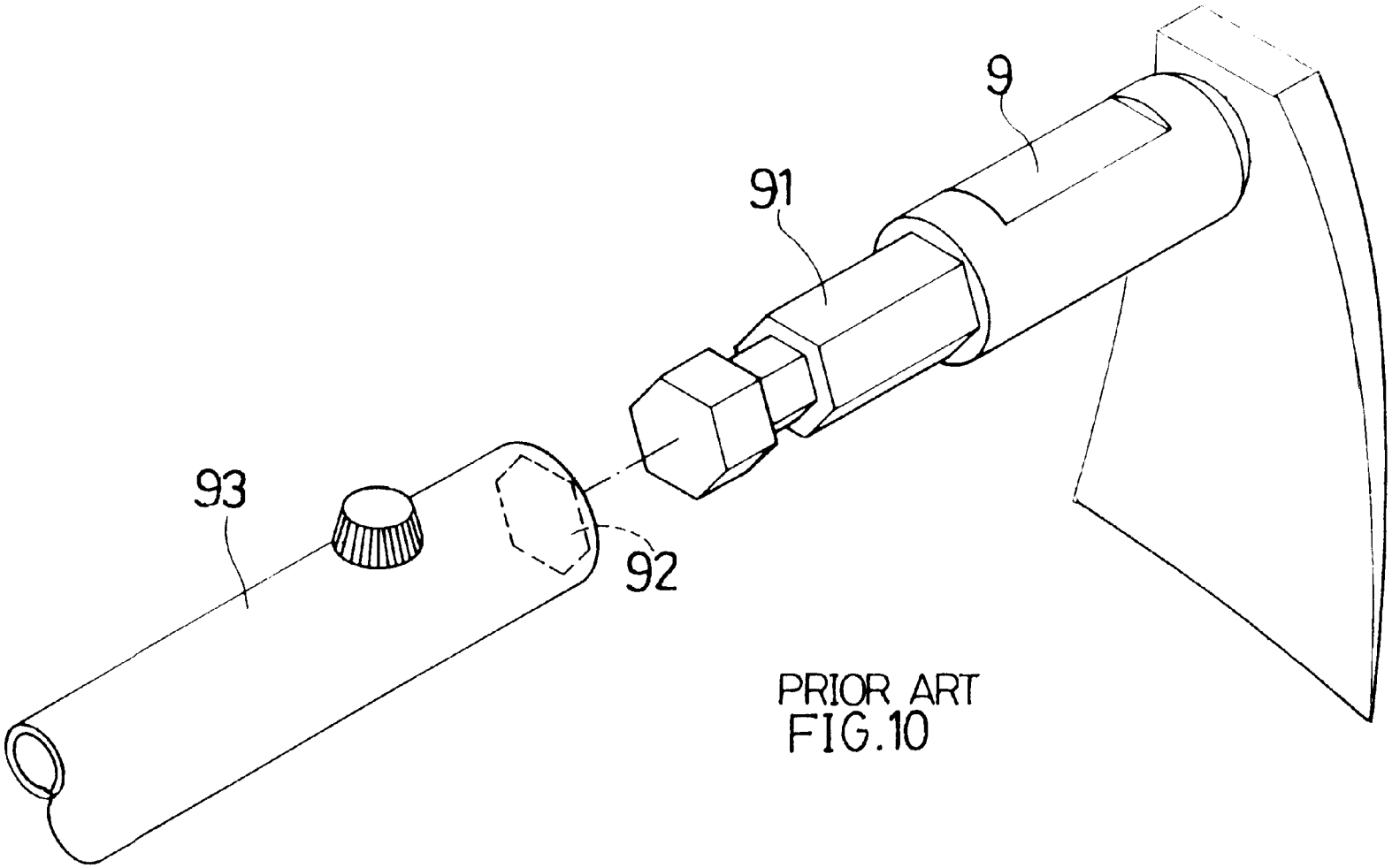
PRIOR ART FIG.10
FIG. 10 is a perspective exploded view of another type of conventional grip and gardening tool head.

The gardening tool locating mechanism 4 is disposed on one side of the grip 3 and includes a push button 41, a spring 42 and a latch board 43. Referring to FIGS. 7 and 8, the latch board 43 is mounted in the push button 41 and the push button 41, together with the latch board 43, is pivotally connected to the grip 3 via a pin member 44. Two ends of the push button 41 are respectively formed with a depression end 411 and a locating end 412. The spring 42 is disposed between the depression end 411 and the grip 3. One end of the latch board 43 protrudes downward from the push button 41 to insert into the socket 25 of the fitting section 24 of the tool head 2. By depressing the depression end 411, the latch board 43 at the locating end 412 is inserted into or extracted from the socket 25 so as to engage the tool head 2 therewith or disengage the tool head 2 form the grip 3. The spring 42 serves to keep the latch board 43 in the inserted position.

Figure 4:
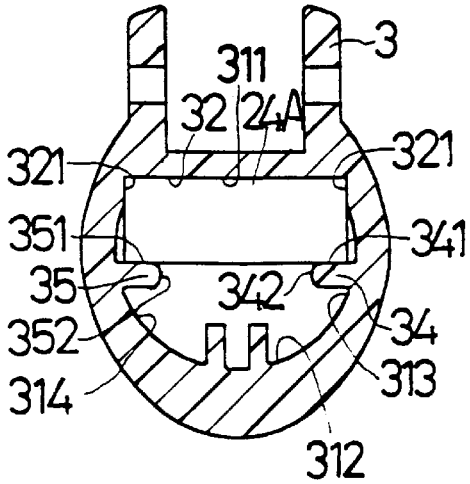
FIG. 4 is a sectional view according to FIG. 3, in which a flat fitting section of a tool head is fitted in the fitting hole of the grip.

Please refer to FIG. 4. A fitting section 24A with a flat cross-section can be inserted into the fitting hole 31 of the grip 3. At this time, the first and fourth engaging faces 32, 341, 351 respectively abut against the upper and lower end faces of the fitting section 24A. Moreover, the fifth engaging faces 321 on left and right sides respectively abut against two lateral faces of the fitting section 24A, so as to avoid rotation of the fitting section 24A.

Figure 5:
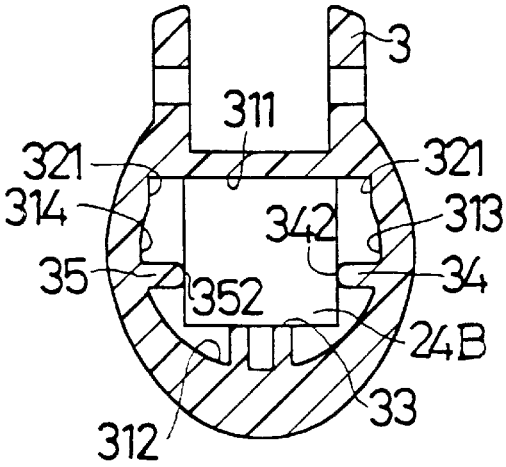
FIG. 5 is a sectional view according to FIG. 3, in which a rectangular fitting section of a tool head is fitted in the fitting hole of the grip.

Referring to FIG. 5, a fitting section 24B with a rectangular cross-section can be also inserted into the fitting hole 31 of the grip 3. At this time, the first, second and third engaging faces 32, 33, 342, 352 respectively abut against lateral sides of the fitting section 24B to avoid rotation of the fitting section 24B.

Figure 6:
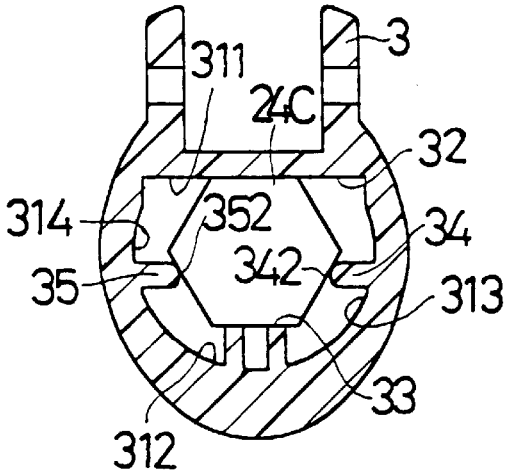
FIG. 6 is a sectional view according to FIG. 3, in which a hexagonal fitting section of a tool head is fitted in the fitting hole of the grip.

Please refer to FIG. 6. A fitting section 24C with a hexagonal cross-section can be also inserted into the fitting hole 31 of the grip 3. At this time, the first and second engaging faces 32, 33, respectively abut against two opposite faces of the fitting section 24C and the third engaging faces 342, 352 respectively abut against two lateral faces on the same side so as to avoid rotation of the fitting section 24C.

In conclusion, the inner wall of the fitting hole 31 of the grip 3 is disposed with multiple symmetrically arranged engaging faces which define a specific space for accommodating a flat, rectangular or hexagonal fitting section 24 of different tools so as to avoid rotation of the fitting section 24. Therefore, the grip 3 can be firmly associated with different tools. In addition, with different tools commonly using the grip 3, the cost of multiple grips is saved.

The above embodiment is only used to illustrate the present invention and not intended to limit the scope thereof. Many modifications of the above embodiment can be made without departing from the spirit of the present invention.

What is claimed is:

1. A grip of a gardening tool, said grip being formed with a fitting hole for insertion of a fitting section of the gardening tool therein, an inner top edge and an inner bottom edge, the fitting hole being respectively formed with a first engaging face and a second engaging face, a left side and a right side of the fitting hole being respectively formed with a first projection and a second projection extending toward an axis of said fitting hole, opposing faces of said first and second projections each being respectively formed with a third engaging face, said first and second projections each respectively having a fourth face opposing said first engaging face and parallel thereto, said fourth face of said first and second projections being at a common height, said fitting hole being further formed with a pair of fifth engaging faces respectively disposed on two sides of said first engaging face, each said fifth engaging face being perpendicular to said first engaging face, said grip including a locating mechanism, said locating mechanism including a push button, a spring and a latch board, said latch board being mounted in said push button and said push button together with said latch board being pivotally connected with said grip via a pin member, said push button being respectively formed with a depression end and a locating end on opposing ends thereof, said spring being disposed between said depression end of said push button and said grip, one end of said latch board protruding downward from said locating end of said push button for insertion into a socket of the fitting section of the gardening tool.

2. A grip of a gardening tool, said grip being formed with a fitting hole for insertion of a fitting section of the gardening tool therein, an inner top edge and an inner bottom edge, the fitting hole being respectively formed with a first engaging face and a second engaging face, a left side and a right side of the fitting hole being respectively formed with a first projection and a second projection extending toward an axis of said fitting hole, opposing faces of said first and second projections each being respectively formed with a third engaging face, said first and second projections each respectively having a fourth face opposing said first engaging face and parallel thereto, said fourth face of said first and second projections being at a common height, said fitting hole being further formed with a pair of fifth engaging faces respectively disposed on two sides of said first engaging face, each said fifth engaging face being perpendicular to said first engaging face, said second engaging face being formed by a combination of engaging faces of two ribs.

* * * * *